United States Patent [19]

Barrett

[11] Patent Number: 4,875,240

[45] Date of Patent: Oct. 24, 1989

[54] PANTS CONSTRUCTION AND ASSOCIATED METHOD

[76] Inventor: Joseph B. Barrett, 192 Moore Ave., Kenmore, N.Y. 14217

[21] Appl. No.: 141,116

[22] Filed: Jan. 5, 1988

[51] Int. Cl.[4] ..... A41D 1/06; A41D 27/20

[52] U.S. Cl. ..... 2/227; 2/247; 2/243 R

[58] Field of Search ..... 2/227, 228, 238, 67, 2/404, 407, 247

[56] References Cited

U.S. PATENT DOCUMENTS

| | | | |
|---|---|---|---|
| 2,116,822 | 5/1938 | Berger | 2/404 |
| 2,242,526 | 5/1941 | Kneibler | 2/404 |
| 4,449,254 | 5/1984 | Fogg | 2/407 |

FOREIGN PATENT DOCUMENTS

| | | | |
|---|---|---|---|
| 21012 | of 1906 | United Kingdom | 2/227 |

*Primary Examiner*—H. Hampton Hunter
*Attorney, Agent, or Firm*—Christel, Bean & Linihan

[57] ABSTRACT

A pair of pants and an associated method of construction utilizes an hourglass-shaped panel and a pair of leg sections each including a tube-like portion operatively attached to the hourglass-shaped panel. The hourglass-shaped panel defines, when placed in a planar, spread condition, two relatively broad parallel edges at opposite ends thereof and a pair of generally C-shaped side edges extending between the broad end edges. Furthermore, the side edges of the hourglass-shaped panel are arranged relative to one another so that the Cs thereof open generally away from one another and so that a neck region is defined substantially midway between the broad edges. Each of the leg sections define an endless upper edge for encircling the corresponding one of the legs adjacent the top thereof, and each leg section is joined to a corresponding one of the C-shaped edges and along seams extending the entire length thereof to operatively join the leg sections to the hourglass-shaped panel. When the pants are operatively worn, the neck region is arranged beneath the wearer's crotch, one of the broad edges is arranged in front of the wearer and generally along the wearer's waistline and the other of the broad edges is arranged in back of the wearer and generally along the wearer's waistline. Furthermore, the seams joining the leg sections to the C-shaped edges simulate the leg-encircling outline of a high rise bathing suit and enhance the wearing comfort of the pants when the pants are worn.

18 Claims, 2 Drawing Sheets

Fig. 1.
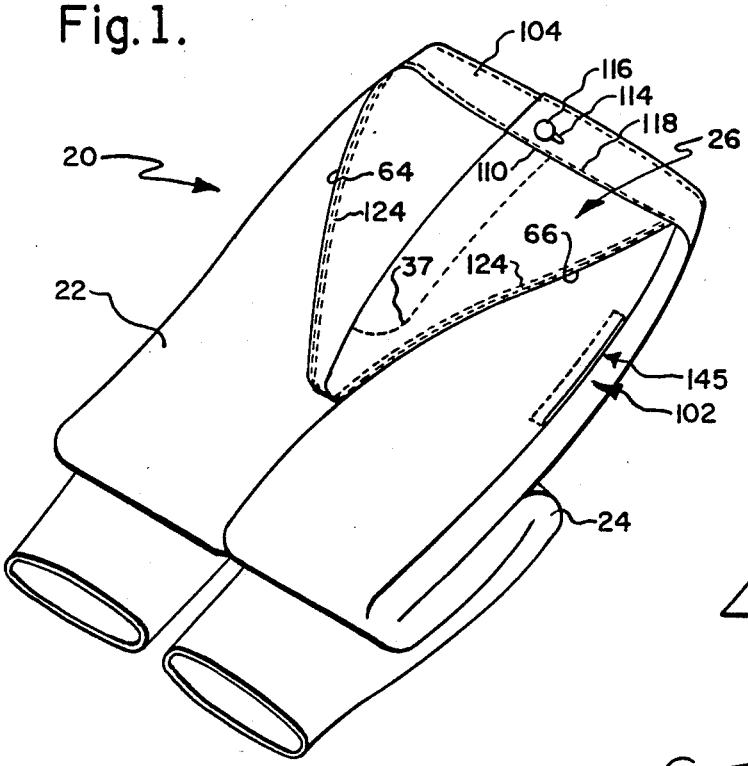
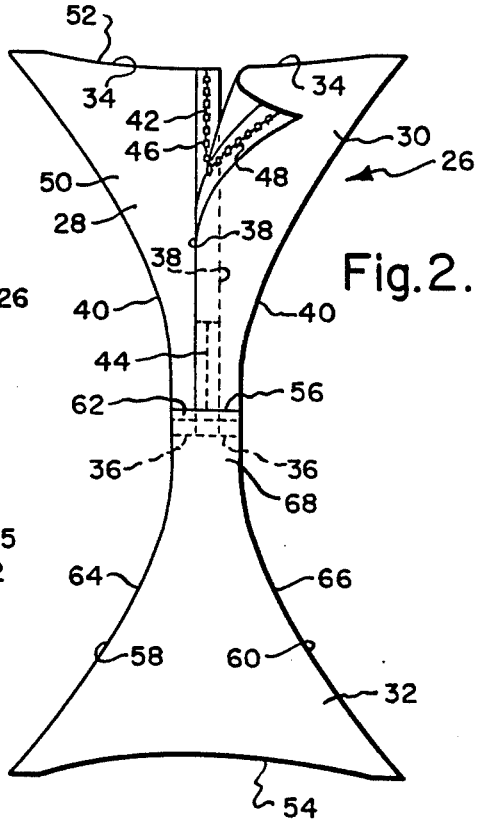
Fig. 2.
Fig. 3.
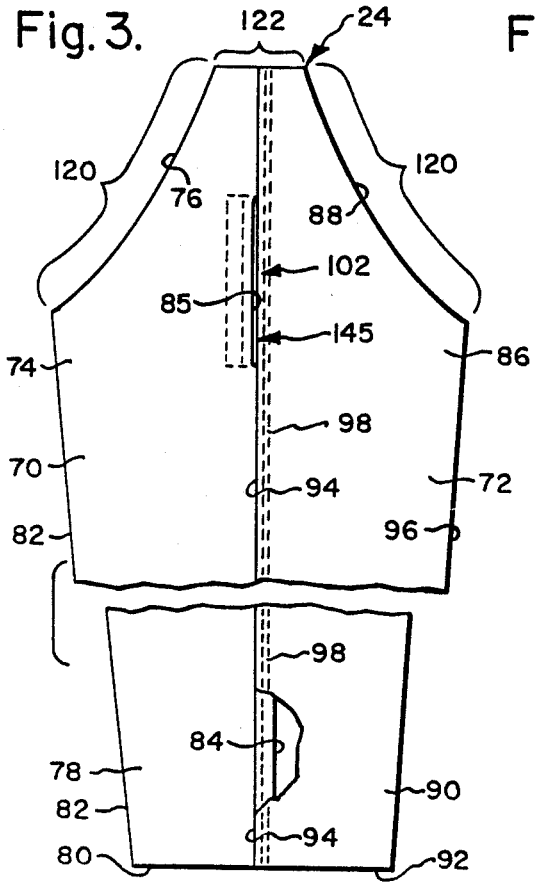
Fig. 4.
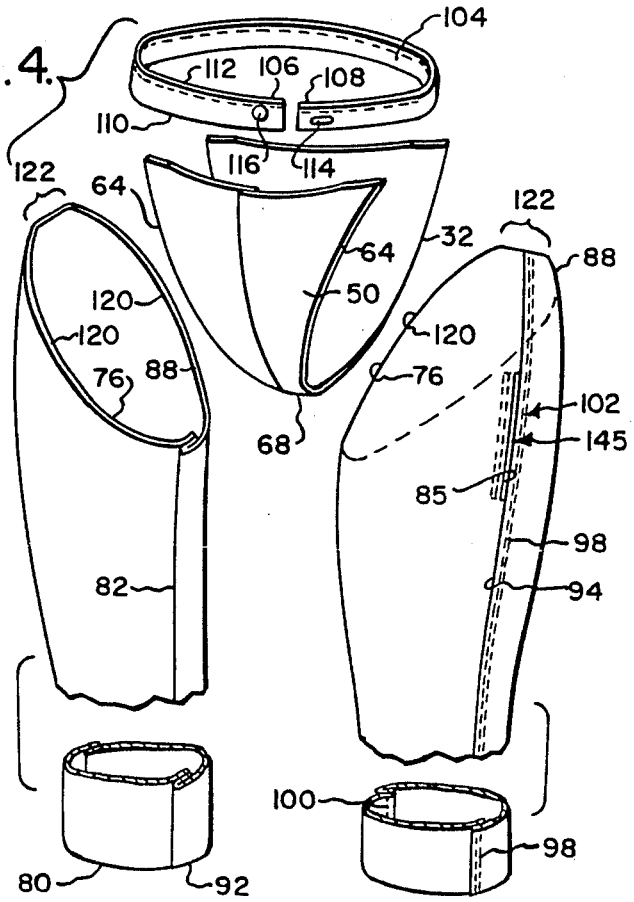

PANTS CONSTRUCTION AND ASSOCIATED METHOD

BACKGROUND OF THE INVENTION

This invention relates generally to pants or trousers and relates more particularly to the construction of a pair of pants and an associated method of constructing the pants.

The type of pants with which this invention is concerned include those intended for use as an outer garment for covering the human body from the waist to the ankles or knees, although the principles of this invention can be variously applied. Commonly, a pair of such pants includes two fabric leg sections in the form of tubes wherein each leg section is adapted to fit about a corresponding leg of the wearer and wherein the leg sections are joined together adjacent the waist region of the wearer at a center seam or rise.

It is an object of the present invention to provide a new and improved pair of pants and an associated method of constructing the pants.

Another object of the present invention is to provide such a pair of pants having a construction which enhances the comfort of the wearer when the pants are worn.

Still another object of the present invention is to provide such a pair of pants which utilizes a relatively small number of fabric pieces in the pants construction.

Yet still another object of the present invention is to provide such a pair of pants which is relatively economical to construct.

A further object of the present invention is to provide such a pair of pants which is relatively uncomplicated in construction and attractive to the eye.

A still further object of the present invention is to provide such a pair of pants having pockets incorporated therein which enhance the wearer-comfort of the pants in the region of the pockets.

One more object of the present invention is to provide such a pair of pants having a construction which facilitates the manufacture of the pants over a relatively wide range of sizes featuring relatively narrow increments within the size range.

SUMMARY OF THE INVENTION

This invention resides in a new and improved pair of pants and a method of constructing the pants.

The pair of pants comprises means defining an hourglass-shaped panel and a pair of leg sections operatively joined to the hourglass-shaped panel. The hourglass-shaped panel is so shaped that when placed in a planar, spread condition the panel defines two relatively broad edges at opposite ends thereof and a pair of generally C-shaped side edges extending between the broad end edges. Furthermore, the side edges are arranged so that the Cs thereof open away from one another and so that a neck region is defined substantially midway between the broad end edges. The hourglass-shaped panel is positionable about the wearer's torso when the pants are operatively worn so that the neck region is arranged beneath the wearer's crotch, one of the broad edges is arranged in front of the wearer and generally along the wearer's waistline and the other of the broad edges is arranged in back of the wearer and generally along the wearer's waistline. Each of the leg sections include a tube-like portion defining an endless upper edge for encircling a corresponding one of the legs adjacent the top thereof. Furthermore, each of the endless upper edges is joined to a corresponding one of the C-shaped edges and along the entire length thereof to operatively join the leg sections to the panel means.

The method of the invention includes the steps involved in constructing the pants of this invention. At the outset of the method, each of the panel means and the pair of leg sections are provided. Each endless upper edges of the leg sections is then joined to a corresponding one of the C-shaped edges of the panel means and along the entire length of the corresponding C-shaped edge to operatively join the leg sections to the panel means so that when the pants are operatively worn, the neck region of the panel is arranged beneath the wearer's crotch, one of the broad edges of the panel is arranged in said front of the wearer and generally along the wearer's waistline and the other of the broad edges of the panel is arranged in back of the wearer and generally along the wearer's waistline.

BRIEF DESCRIPTION OF THE DRAWING FIGURES

FIG. 1 is a perspective view of a pair of pants in accordance with the present invention.

FIG. 2 is a plan view of the mid-panel of the FIG. 1 pants when placed in a planar, spread condition and having a portion folded back upon itself.

FIG. 3 is a plan view of a leg section of the FIG. 1 pants shown at one stage of assembly and having a portion cutaway.

FIG. 4 is a perspective view of the FIG. 1 pants shown exploded.

DETAILED DESCRIPTION OF AN ILLUSTRATED EMBODIMENT

Figure 5:
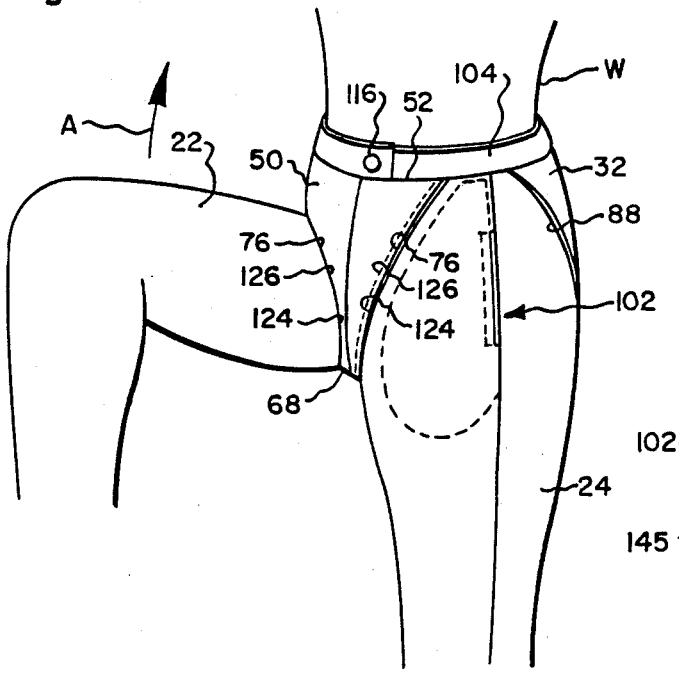
FIG. 5 is a perspective view of the FIG. 1 pants being worn.

Turning now to the drawings in greater detail and considering first FIG. 1, there is shown a pair of pants, generally indicated 20, in acordance with the present invention. The pants 20 include two leg sections 22,24 adapted to fit about the right and left leg, respectively, of a wearer W (FIG. 5) and panel means, generally indicated 26, disposed intermediate or medially of the legs sections 22,24 and which join the leg sections 22,24 together. As is described herein, the leg sections 22,24 are joined to the panel means 26 along seam lines arranged in a manner promoting wearer comfort and mobility.

With reference to FIG. 2, the panel means 26 is comprised of three pieces 28, 30, 32 of fabric joined together to form a single panel which when placed in the planar, spread condition of FIG. 2 is generally hourglass-shaped in appearance. Each of the pieces 28 or 30 is shaped so as to define two opposite, straight edges 34,36, a straight edge 38 and an arcuate edge 40 extending between the edges 34,36. Edge 36 is generally straight, and edge 34 is somewhat arcuate in shape so as to provide appearance of a relatively shallow curve as shown in FIG. 2. The pieces 28 and 30 are joined together by means of a zipper 42 and a seam line 44. More specifically, the zipper 42 includes cooperating portions 46,48 each operatively sewn to a corresponding one of the fabric pieces 28,30 along a seam line 37 (FIG. 1) adjacent the edge 38 thereof so as to extend from the edge 34 and terminate at a location spaced from the edge 36. The seam line 44 contains stitches joining the pieces 28,30 which stitches extend from the edges 36,36 to the location at which the zipper 42 terminates. Therefore, when the zipper 42 is fully closed, the zipper 40 and seam line 44 cooperate to join the pieces 28 and 30 and into a front panel portion, indicated 50, wherein the arcuate edges 40,40 are arranged on opposite sides of the panel portion 50 and the edges 34,34 collectively provide a single, broad edge 52 extending between the arcuate edges 40,40.

The piece 32 is shaped so as to define a generally broad edge 54 defining a relatively shallow arc, a generally straight narrow edge 56 opposite the edge 54 and two opposite arcuate edges 58,60 extending between the edges 54,56 as shown in FIG. 2. The piece 32 is joined by means of a seam line 62 to the front panel portion 50 along the piece edge 36,36 to complete the assembly of the panel means 26. Joined as aforesaid, the front panel portion 50 and piece 32 collectively define the hourglass shape of the panel means 26 so that the broad edges 52 and 54 provide opposite end edges of the panel means 26 and the arcuate edges 40,58 and 40,60 collectively define opposite arcuate edges 64,66, respectively, which are each somewhat C-shaped in appearance as viewed in FIG. 2. Furthermore, the panel means 26 is shaped so that the Cs of its C-shaped edges 64,66 open in opposite directions and a relatively narrow neck region 68 is defined generally midway between the broad end edges 52 and 54 of the panel means 26.

Figure 6:
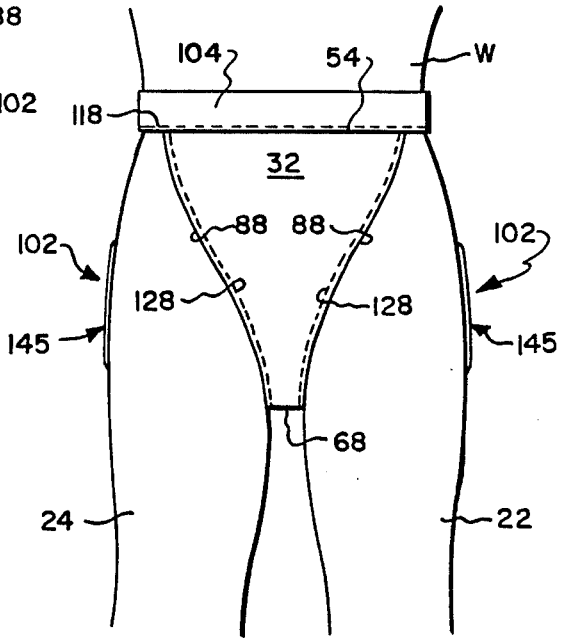
FIG. 6 is a rear elevational view of the FIG. 1 pants when worn.

When the pants 20 are operatively worn and as best shown in FIGS. 5 and 6, the panel means 26 is positioned about the lower portion of the wearer's torso so that the neck region 68 is arranged beneath the wearer's crotch and the front panel portion 50 and piece 32 are arranged generally in front and in back, respectively, of the wearer. Furthermore, the broad edge 52 associated with the front panel portion 50 is arranged generally along the wearer's waistline and positioned substantially centrally between the wearer's sides, and the broad edge 54 associated with the piece 32 is arranged generally along the wearer's waistline and positioned substantially centrally between the wearer's sides.

With reference to FIGS. 3 and 4, each leg section 22 or 24 is comprised of a pair of elongated pieces 70,72 of fabric joined together to form a tube or cylinder for receiving a corresponding leg of the wearer. Fabric piece 70 includes an upper portion 74 having a top edge 76 and a lower portion 78 having a bottom edge 80 and defines two side edges 82,84 extending between the top and bottom edges 76 and 80. For a reason apparent herein, side edge 84 defines a cutout 85 in the upper portion 74 as shown in FIG. 3. Fabric piece 72 includes an upper portion 86 having a top edge 88 and a lower portion 90 having a bottom edge 92 and defines two side edges 94,96 extending between the top and bottom edges 88 and 92.

As best shown in FIG. 4, fabric pieces 70 and 72 are operatively joined together in a tube-like arrangement wherein side edges 94 and 84, excepting cutout 85, are stitched together along a pair of seam lines 98 extending along the length of the leg section 22 or 24 and wherein side edges 82 and 96 are stitched together along an inner seam line 100 extending between the top edges 78,88 and bottom edges 80,92 as illustrated in FIG. 4. The cutout 85 is left unattached to the side edge 94 so as to provide an opening for a pocket 102 incorporated within each leg section 22 or 24.

In accordance with the present invention, the top edges 76,88 of the fabric pieces 70,72 are of such shape that when the pieces 70,72 are joined in their tube-forming condition illustrated in FIG. 4 and the pants 20 are operatively worn,the top edges 76,88 collectively encircle the upper portion of a corresponding one of the wearer's legs. It follows that the top edges 76,88 collectively form an endless edge for encircling the upper portion of the wearer's leg when the pieces 70,72 are joined. Furthermore and with reference to FIG. 5, the top edge 76 extends generally across the front of the wearer from a location situated along a corresponding side and adjacent the waist region of the wearer to a location adjacent the wearer's crotch. Still further and with reference to FIG. 6, the top edge 88 extends across the back of the wearer from a location situated along the side and adjacent the waist region of the wearer to a location adjacent the wearer's crotch. Furthermore, the top edges 76 and 88 are of such shape that when operatively encircling the wearer's leg as shown in FIG. 5, edges 76 and 88 generally correspond with the corresponding C-shaped edge 64 or 66.

In accordance with the present invention and with reference again to FIGS. 1 and 5, the leg sections 22,24 are operatively joined to the panel means 26 along a pair of seam lines 124 extending along the C-shaped edges 64,66 of the panel means 26 and a major portion, indicated 120 in FIGS. 3 and 4, of the top edges 76,78 of each leg section 22 and 24. When positioned in operative relationship with the panel means 26, a minor portion, indicated 122, of the top edges 76,78 of each leg section 22 and 24 is positioned generally between the front panel portion 50 and the back piece 32 so that the broad edges 52,54 of the panel 26 and the top edge portion 122 of both leg sections 22 and 24 collectively encircle the wearer in the region of the wearer's waist. Hence, each C-shaped edge 64 or 66 of the panel means 26 is stitched along its entire length to only the major portion 120 of the top edges 76,88 of a corresponding leg section 22 or 24. For purposes of stitching the panel means 26 to the leg sections 22,24, a relatively small strip of each leg section 22 or 24 adjacent the top edge portion 120 is positioned in overlying relationship with a relatively small strip of the panel means 26 adjacent a corresponding one of the C-shaped edges 64,66, and the seam 124 is formed with threads which are directed through the overlying strips.

With reference to FIGS. 1 and 4, the pants 20 further includes a band 104 of fabric stitched to the panels means 26 and the leg sections 22,24 so as to provide a waistband for the pants. As best illustrated in FIG. 4, the band 104 is elongate in shape so as to define two end portions 106,108, two opposite sides edges 110,112 and is relatively narrow as measured between the side edges 110,112. A buttonhole 114 is defined in the band end portion 108, and a button 116 adapted to cooperate with the buttonholde 114 for buttoning the band end portions 106,108 is fixedly secured to the band end portion 106. The band 104 is sewn to the panel means 26 and the leg sections 22,24 along a seam line 118 (FIG. 1) extending generally alongside the band side edge 110 and alongside the edges 52,54 of the panel means 26. As best shownin FIG. 4, the band end portion 108 generally corresponds with the panel means piece 30 and the band end portion 110 generally corresponds with the panel means piece 28 so that the fly of the pants 20 can be opened and closed by appropriate manipulation of the button 116 and zipper 42.

When the pants 20 are operatively worn and in accordance with the present invention, each seam 124 at which the panel means 26 is operatively joined to a corresponding one of the leg sections 22,24 includes a front section, indicated 126 in FIG. 5, which extends from a location situated along a corresponding side of and adjacent the waist region of the wearer to a location adjacent the wearer's crotch. Furthermore, the front section 126 of each seam 124 extends across the wearer's skin at which a corresponding one of the wearer's leg bends relative to the lower portion of the wearer's torso.

For example and as illustrated in FIG. 5, when the wearer W lifts his right leg in the direction of the arrow A so that his right knee is raised directly in front of the wearer, the upper portion of the right leg bends relative to the torso generally along the seam front section 126. The positioning of the seam front section 126 relative to the wearer's skin as aforesaid is advantageous in that it enhances the comfort of the wearer when the pants are worn and permits the wearer to bend his legs in the aforedescribed manner with relative ease. Thus, the pants 20 are believed to enhance the mobility of the wearer when wearing the pants 20.

Furthermore, and with reference to FIG. 6, each seam 124 includes a back section 128 which extends across the back of the wearer W, when the pants 20 are operatively worn, from a location situated along the side and adjacent the waist region of the wearer to a location adjacent the wearer's crotch. Extending between the side location and crotch as aforesaid, the seam back section 128 passes over substantially the center of a corresponding one of the wearer's buttocks. Such an arrangement of the seam sections 128 relative to the wearer's buttocks is believed to enhance the attractiveness of the pants and the wearer as seen from the back.

Still further and as illustrated in FIGS. 1, 5 and 6, the front and back seam sections 126 and 128 collectively simulate the leg-encircling outline of a bathing suit commonly known as a high rise or French cut bathing suit and so that the seam sections 126 and 128 provide the appearance of a "V" when the pants 20 are viewed toward the front or toward the rear. Such an outline is believed to highlight the wearer's figure and makes the legs appear longer. Yet still further, the front and back seam sections 126 and 128 extend across the area of the pants 20 where wrinkles and creases in the pants 20 would normally appear when the pants are worn. Such an extension of the seam sections 126 and 128 effectively conceals such wrindles and creases from view.

Another advantage of the pants 20 relates to the neck region 68 of the panel means 26 and the comfort of the wearer afforded by the neck region 68. More specifically, the neck region 68, although relatively narrow when compared to the length of either of the broad edges of the panel means 26, is believed to be wide enough to render the pants 20 more comfortable than are conventional pants having leg sections which meet at a line or point in the crotch area. To this end and in accordance with the present invention, the distance as measured transversely across the neck region 68 of the panel means 26 is within the range of about one inch to two inches ((2.5 cm to 5.1 cm).

Still another advantage of the pants 20 relates to the capacity of the pants to be manufactured over a relatively wide range of sizes featuring relatively narrow increments within the size range. Such a capacity is believed to be due to the relatively large number of edges (i.e. fourteen) associated with the panel means 26 and leg sections 22,24 which can be trimmed or cut-to-size to accommodate the manufacture of pants of different sizes.

Each of the fabric pieces 28,30,32 of the panel means 26 and the fabric pieces 70,72 of each leg section 22 or 24 can be constructed of any of a number of conventional flexible fabric materials commonly utilized in pants construction. To provide the resultant pants 20 with a relatively attractive and graceful appearance, the fabric pieces 28,30,32, 70,72 are preferably constructed of a sturdy cottom cloth or other jean material so that the resultant pants 20 comprises a pair of jeans.

Figure 7:
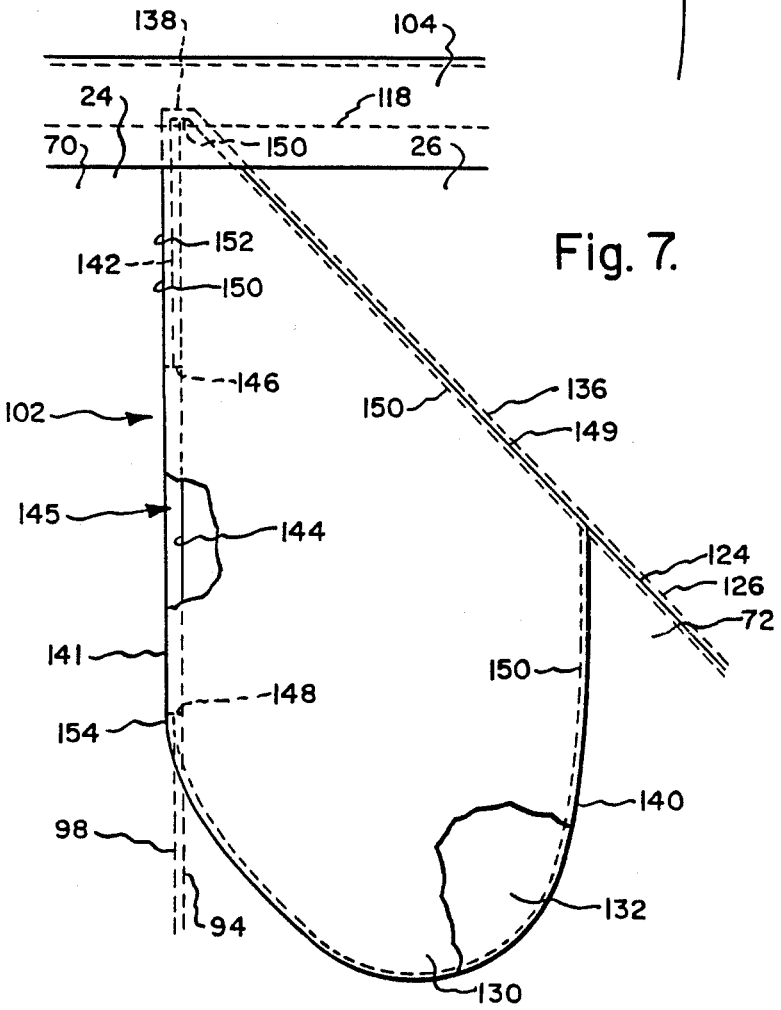
FIG. 7 is an elevation view of a pocket of the FIG. 1 pants as viewed toward the inside surface of the corresponding pants leg section to which the pocket is attached and having portions cutaway.

With reference to FIG. 7, each pocket 102 of the pants 20 includes two pieces 130,132 stitched together and along preselected seams of the pants 20 so that each pocket 102 is maintained generally against the inside surface of the corresponding leg section 22 or 24. To this end, each piece 103 or 132 possesses substantially the same edge outline as the other piece 132 or 130 along a side edge indicated 136, a top edge indicated 138 and an arcuate edge indicated 140 opposite the top edge 138. Piece 130 further defines a generally straight side edge 141, and piece 132 further defines a corresponding side edge 142 having a cutout 144. The pieces 130,132 are positioned in overlying relationship with one another so that the comparable edges correspond with one another and the comparable edges, with the exception of the edges 141 and 142, are stitched together along the length thereof. Edges 141 and 142 are stitched to one another along a seam line 150 having a portion 152 extending downwardly, as viewed in FIG. 7, from the top edges 138 to an edge indicated 146, of the cutout 144 and along another portion 1154 of the seam line 150 extending upwardly, as viewed in FIG. 7, to an edge, indicated 148, of the cutout 144. Hence, the edges of the pieces 130,132 are joined to form a pocket enclosure having a pair of opposing walls and defining a single opening, indicated generally 145, at the cutout 144. Because the pocket piece edges 140 are arcuate in shape as shown in FIG. 7, each pocket enclosure defined by the pieces 130,132 is mitt-like for receiving a hand of the wearer.

With reference still to FIG. 7, the edges of the joined pocket pieces 130,132 are stitched to the corresponding leg section 22 or 24 along a seam 150, introduced above, extending around the pocket periphery. More specifically and as viewed in FIG. 7, the seam 150 has portions which extend along the side seam 98, top seam 118 and front section 126 of the seam line 124 to operatively join the side edge 141, top edge 138 and side edge 136, respectively, of pocket piece 130 to the remainder of the pants 20. The pocket piece 130 is stitched along the cutout 144 to the cutout 85 of the corresponding leg section piece 70 so that the opening 145 of the pocket 102 corresponds with the slit or unstitched opening provided along the leg section cutout 85.

It follows from the foregoing that the pocket pieces 130,132 are stitched to the remainder of the pants 20 along seam lines 98,118 and 126 for a substantial distance around the periphery of the pieces 130,132. Such an attachment of the pocket pieces 130,132 to the remainder of the pants 20 incorporates a major portion of the periphery of each pocket 102 within seam lines of the pants 20 which would exist even if the pockets 102 were not included in the pants 20. Furthermore, inasmuch as the pieces 130,132 are positioned in a generally flat condition against the inside surface of the corresponding leg section, such an attachment of the piece 130,132 along the seam lines 98,118 and 126 as aforedescribed maintains the pockets 102 in a relatively flat condition against the leg section when the pants 20 are operatively worn. Such a maintenance of the pockets 102 in a flat condition is believed to enhance the wearer-comfort of the pants 20.

Another advantage resulting from such an attachment of the pockets 102 to the remainder of the pants 20 can be readily appreciated when considering the fact that pockets of many conventional pants may be outlined against the skin of the wearer as the pockets are normally pressed between the wearer's skin and the leg section of the pants along which the pockets normally extend. Such an outlining of the pockets renders visible through the leg section the peripheral edge of the pockets. From the standpoint of appearance, it is preferred that as little of the pocket periphery as possible be viewable through the leg section. Inasmuch as only the arcuate edges 140 of the pocket pieces 130,132 are unstitched along predetermined seam lines 98,118 and 124 of the pants 20, only a relatively small fraction of the pocket periphery is ever outlined against the wearer's skin in a manner rendering the outline of the periphery viewable through the leg section 22 or 24.

The method of the invention includes the steps involved in constructing the pants 20 of this invention. At the outset of the construction process, leg section pieces 70 and 72, pocket pieces 103,132, panel means 28,30,32, including zipper 40, and waistband piece 104 with button 116 and buttonhole 114 are provided. The leg section pieces 70,72 are then joined to one another along seam lines 98 and 100 to form a leg-accepting tube, and the pocket pieces 130,132 are operatively stitched to one another along their comparable edges 136,138, 140. The joined pocket pieces 130,132 are thereafter joined to a corresponding leg section 22 or 24 as the piece edge 141 is stitched along the seam 98 and the cutout 144 is stitched along the leg piece cutout 85. The pieces 28,30 and 32 are then joined together along seam lines 44 (FIG. 2) and 62 to complete the panel means 26.

With reference again to FIGS. 1, 4, and 7, the panel means 26 and leg sections 22,24 are then sewn together along seam lines 124 as aforedescribed and the side edges 136 of the pockets 102 are operatively sewn along the front section 126 of the seam lines 124 to join the pocket piece edges 136 thereto. The waistband piece 104 is thereafter operatively joined to the panel means 26 and leg sections 22,24 along seam line 118, and the top edges of the pockets 102 are operatively sewn along the seam line 118 to join the edges 138 thereto.

It will be understood that numerous modifications and substitutions can be had to the aforedescribed embodiment 20 without departing from the spirit of the invention. For example, although the panel means 20 of the aforedescribed embodiment has been shown and described as including three pieces 28,30,32, a pair of pants in accordance with the present invention may include a panel means comprised of a single piece of fabric. Accordingly, the aforedescribed embodiment is intended for the purpose of illustration and not as limitation.

I claim:

1. A pair of pants comprising:

panel means for covering the front and back lower portion of a wearer's torso, said panel means including a symmetrical hourglass shaped panel which, when placed in a planar, spread condition, defines two relatively broad edges at opposite ends thereof and a pair of curved generally C-shaped side edges extending between said broad end edges, said side edges being arranged relative to one another so that the Cs thereof open generally away from one another and so that a neck region is defined about midway between the broad edges, said hourglass-shaped panel being positionable about the wearer's torso when the pants are operatively worn so that said neck region is arranged beneath the wearer's crotch, one of said broad edges is arranged in front of the wearer and generally along the wearer's waistline and the other of said broad edges is arranged in back of the wearer and generally along the wearer's waistline;

a pair of leg sections each including a tube-like portion defining an upper endless edge for encircling a corresponding one of the wearer's legs adjacent the top thereof, each of said endless upper edges being joined to a corresponding one of said C-shaped edges and along the entire length thereof to operatively join said leg section to said panel means; and waistband means extending along both of said broad edges of said panel means and along a portion of each of said upper endless edges of said leg sections and including connecting means so that said pants fit around the waist of the wearer.

2. The pants defined in claim 1 wherein each of said C-shaped edges is joined to a corresponding one of said leg sections along a seam having a front section extending, when said pants are operatively worn, across the front of the wearer from a location situated along a corresponding side and adjacent the waist region of the wearer to a location adjacent the wearer's crotch.

3. the pants as defined in claim 2 wherein said front section of each seam extends along a path which generally corresponds with the path across the wearer's skin at which a corresponding one of the wearer's leg bends relative to a lower portion of the wearer's torso.

4. The pants as defined in claim 2 wherein each of said endless edges of said leg sections is joined to a corresponding one of said C-shaped edges along said front section of said seam.

5. The pants as defined in claim 1 wherein each of said C-shaped edges is joined to a corresponding one of said leg sections along a seam having a back section extending, when said pants are operatively worn, across the back of the wearer from a location situated along the side and adjacent the waist region of the wearer to a location adjacent the wearer's crotch.

6. The pants as defined in claim 5 wherein said back section of each seam extends generally across the center of a corresponding one of the wearer's buttocks.

7.The pants as defined in claim 5 wherein each of said endless edges of said leg sections is joined to a corresponding one of said C-shaped edges along said back section of a corresponding one of said seams.

8. The pants as defined in claim 1 wherein each of said C- shaped edges is joined to a corresponding one of said leg sections along a seam having a front section and a back section, said front section extending, when said pants are operatively worn, across the front of the wearer from a location situated along a corresponding side and adjacent the waist region of the wearer to a location adjacent the wearer's crotch, and said back section extending, when said pants are operatively worn, across the back of a wearer from a location situated along the side and adjacent the waist region of the wearer to a location adjacent the wearer's crotch.

9. The pants as defined in claim 9 wherein the front section of each seam extends along a path which generally corresponds with the path across the wearer's skin at which a corresponding one of the wearer's legs bends relative to the lower portion of the wearer's torso and the back section of each seam extends generally across the center of a corresponding one of the wearer's buttocks.

10. The pants as defined in claim 1 wherein the distance as measured across said neck region of said panel is within the range of about one to two inches (2.5 to 5.1 cm) to enhance the wearing comfort of the pants in the region of the wearer's crotch.

11. A pair of pants comprising:

panel means for covering the front and back lower portion of a wearer's torso, said panel means including hourglass shaped panel which, when placed in a planar, spread condition, defines two relatively broad edges at opposite ends thereof and a pair of generally C-shaped side edges extending between said broad end edges, said side edges being arranged relative to one another so that the Cs thereof open generally away from one another and so that a neck region is defined about midway between the broad edges, said hourglass-shaped panel being positionable about the wearer's torso when the pants are operatively worn so that said neck region is arranged beneath the wearer's crotch, one of said broad edges is arranged in front of the wearer and generally along the wearer's waistline and the other of said broad edges is arranged in back of the wearer and generally along the wearer's waistline;

a pair of leg sections each including a tube-like portion defining an upper endless edge for encircling a corresponding one of the wearer's legs adjacent the top thereof, each of said endless upper edges being joined to a corresponding one of said C-shaped edges and along the entire length thereof to operatively join said leg section to said panel means;

waistband means extending along both of said broad edges of said panel means and along a portion of each of said upper endless edges of said leg sections and including connecting means so that said pants fit around the waist of the wearer; and wherein at least one pair of leg sections includes a side seam extending along the side of a wearer's leg when said pants are operatively worn and defines an opening along a section of said side seam for a pocket therealong and said pants further include a pocket defining a peripheral edge therearound and a pocket opening and including means defining a pair of opposing walls, said wall-defining means being joined together along said peripheral edge of said pocket and positioned in a generally flat condition against the inside surface of said leg section, said pocket being joined to said side seam so that said pocket opening corresponds with said opening in said side seam, a substantial portion of the peripheral edge of said pocket being joined to the remainder of said pants along said side seam and along a corresponding C-shaped edge of said panel means so that said wall-defining means are maintained in the relatively flat condition against the inside surface of said leg section.

12. The pants as defined in claim 11 wherein said wall-defining means of said pockets include two pieces of material positioned in overlying relationship and stitched together along the edges thereof.

13. The pants as defined in claim 11 wherein each of said C-shaped edges is joined to a corresponding one of said leg sections along a seam having a front section extending, when said pants are operatively worn, across the front of the wearer from a location situated along a corresponding side and adjacent the waist region of the wearer to a location adjacent the wearer's crotch, and a portion of the peripheral edge of said pocket is sewn along said front seam section.

14. The pants as defined in claim 11 wherein said pocket is shaped so as to provide a mitt-like pouch for a hand positioned therein.

15. A pair of pants comprising:

panel means defining a symmetrical hourglass-shaped panel which when placed in a planar, spread condition defines two relatively broad parallel edges at opposite ends thereof and a pair of curved generally C-shaped side edges extending between said broad end edges, said Cs being arranged relative to one another so that a neck region is defined substantially midway between said broad edges, said hourglass shaped panel being positionable about the wearer's torso when the pants are operatively worn so that said neck region is arranged beneath the wearer's crotch, one of said broad edges is arranged in front of the wearer and generally along the wearer's waistline and the other of said broad edges is arranged in back of the wearer and generally along the wearer's waistline;

a pair of leg sections for positioning about the legs of the wearer and each including a tube-like portion defining an endless upper edge for encircling a corresponding one of the wearer's legs adjacent the top thereof;

waistband means extending along both of said broad edges of said panel means and along a portion of each of said upper endless edges of said leg sections and including connecting means so that said pants fit around the waist of the wearer; and each of said C-shaped edges of said panel being joined to a corresponding one of said endless upper edges of said leg section along a seam which extends along the full length of the C-shaped edge and which has a front section which extends, when the pants are operatively worn, obliquely across the front of the wearer from a location situated along a corresponding side and adjacent the waist region of the wearer to a location adjacent the wearer's crotch and a back section which extends, when the pants are operatively worn, obliquely across the back of the wearer from a location situated along one side and adjacent the waist region of the wearer's crotch so that when the pants are viewed from the front and the back, the front seam sections and the back seam sections simulate the leg-encircling outline of a high rise bathing suit.

16. A method of constructing a pair of pants comprising the steps of:

providing panel means for covering the front and back lower portion of the wearer's torso including a symmetrical hourgalss-shaped panel which, when in a planar, spread condition, defines two relatively broad parallel edges at opposite ends thereof and a pair of curved generally C-shaped side edges extending between said broad edges, said side edges being arranged relative to one another so that the Cs thereof open generally away from one another and so that a neck region is defined substantially midway between the broad edges;

providing a pair of leg sections each including a tube-like portion defining an endless upper edge for encircling a corresponding one of the legs adjacent the top thereof;

joining each of said endless upper edges of said leg sections to a one corresponding one of said C-shaped edges of said panel means and along the entire length of the corresponding C-shaped edges to operatively join said leg sections to said panel means and so that when said pants are operatively worn, said neck region is arranged beneath the wearer's crotch, one of said broad edges is arranged in said front of the wearer and generally along the wearer's waistline and the other of said broad edges is arranged in back of the wearer and generally along the wearer's waistline; and providing waistband means extending along both of said broad edges of said panel means and along a portion of each of said upper endless edges of said leg sections and including connecting means so that said pants fit around the waist of the wearer.

17. A method of constructing a pair of pants comprising the steps of:

providing panel means for covering the front and back lower portion of a wearer's torso including an hourglass-shaped panel which, when in a planar, spread condition, defines two relatively broad parallel edges at opposite ends thereof and a pair of generally C-shaped side edges extending between said broad edges, said side edges being arranged relative to one another so that the Cs thereof open generally away from one another and so that a neck region is defined substantially midway between the broad edges;

providing a pair of leg sections each including a tube-like portion defining an endless upper edge for encircling a corresponding one of the legs adjacent the top thereof, at least one of said leg sections including a side seam extending along the side of the wearer's leg when said pants are operatively worn and which defines an opening along a section of said side seam for a pocket;

joining each of said endless upper edges of said leg sections to a one corresponding one of said C-shaped edges of said panel means and along the entire length of the corresponding C-shaped edges to operatively join said leg sections to said panel means and so that when said pants are operatively worn, said neck region is arranged beneath the wearer's crotch, one of said broad edges is arranged in said front of the wearer and generally along the wearer's waistline and the other of said broad edges is arranged in back of the wearer and generally along the wearer's waistline;

providing a pocket defining a peripheral edge therearound and a pocket opening and including means defining a pair of opposing walls being joined together along the peripheral edge of said pocket and being positionable in a relatively flat condition, positioning said wall-defining means in a relatively flat condition against the inside surface of said one leg section and joining said pocket to said side seam so that said pocket opening corresponds with said opening in said side seam and joining a substantial portion of the peripheral edge of said pocket to the remainder of said pants along said side seam and along a corresponding C-shaped edge of said panel means so that the wall-defining means of said pocket are maintained in the relatively flat condition against the inside surface of said leg section.

18. The method of claim 17 wherein said step of joining each of said endless upper edges joins the endless upper edge of said one leg section to the corresponding C-shaped edge of said panel means along a seam having a front section extending, when said pants are operatively worn, from a location situated along a corresponding side and adjacent the waist region of the wearer to a location adjacent the wearer's crotch and said step of joining a substantial portion of the peripheral edge of said pocket along said C-shaped edge joins the peripheral edge to said panel means along the front section of said seam.

* * * * *